US005649873A

United States Patent [19]

Fuller

[11] Patent Number: 5,649,873

[45] Date of Patent: Jul. 22, 1997

[54] GOLF CULB WITH FILLER MATERIAL IN THE HEAD

[76] Inventor: B. Shannon Fuller, 1605 N. Observatory Dr., Nashville, Tenn. 37215

[21] Appl. No.: 645,805

[22] Filed: May 14, 1996

[51] Int. Cl.[6] ..... A63B 53/04

[52] U.S. Cl. ..... 473/332; 473/334; 473/345

[58] Field of Search ..... 473/324, 345, 473/346, 347, 349, 291, 332, 329, 334

[56] References Cited

U.S. PATENT DOCUMENTS

| | | |
|---|---|---|
| 4,432,549 | 2/1984 | Zebelean . |
| 4,438,931 | 3/1984 | Motomiya . |
| 4,502,687 | 3/1985 | Kochevar . |
| 4,928,972 | 5/1990 | Nakanishi . |
| 5,244,211 | 9/1993 | Lukasiewicz . |
| 5,290,036 | 3/1994 | Fenton . |
| 5,316,298 | 5/1994 | Hutin . |
| 5,351,958 | 10/1994 | Helmstetter . |
| 5,393,800 | 2/1995 | Grosclaude . |
| 5,411,255 | 5/1995 | Kurashima . |
| 5,431,396 | 7/1995 | Shieh . |

FOREIGN PATENT DOCUMENTS

| | | | |
|---|---|---|---|
| 2003 | of 1914 | United Kingdom | 273/78 |
| 216018 | 5/1924 | United Kingdom | 273/78 |

*Primary Examiner*—Sebastiano Passaniti
*Attorney, Agent, or Firm*—Adams Law Firm, P.A.

[57] ABSTRACT

A vibration-dampening golf club has a grip section, an elongated shaft attached to the grip section, and an enlarged head attached to the shaft and defining a cavity therein. A filler material is contained in the cavity and adheres to an inside wall of the head for dampening the vibration of the club upon impacting a golf ball. The filler material includes cork particles.

7 Claims, 2 Drawing Sheets

GOLF CULB WITH FILLER MATERIAL IN THE HEAD

TECHNICAL FIELD AND BACKGROUND OF THE INVENTION

This invention relates to a golf club with a filler material located in the head to dampen the vibration of the club upon impacting a golf ball. The filler material is made of readily available and inexpensive components, and is conveniently inserted in the head of both new and used clubs. The precise amount of filler material in the head may be adjusted to suit an individual user.

SUMMARY OF THE INVENTION

Therefore, it is an object of the invention to provide a golf club which includes a filler material in the head to dampen the vibration of the club upon impacting a golf ball.

It is another object of the invention to provide a method of constructing a golf club with means for dampening the vibration of the club upon impacting a golf ball.

These and other objects of the present invention are achieved in the preferred embodiments disclosed below by providing a vibration-dampening golf club having a conventional grip section, an elongated shaft attached to the grip section, and an enlarged head attached to the shaft and defining a cavity therein. The improvement includes a filler material contained in the cavity and adhering to an inside wall of the head for dampening the vibration of the club upon impacting a golf ball. The filler material includes cork particles.

According to one preferred embodiment of the invention, the filler material includes a urethane oligomer for bonding the cork particles together.

According to another preferred embodiment of the invention, the urethane oligomer is an aliphatic urethane oligomer.

According to yet another preferred embodiment of the invention, the filler material includes an adhesion promoter for adhering the cork particles directly to the inside wall of the head.

According to yet another preferred embodiment of the invention, the thickness of the filler material adjacent to the inside wall of the head is between 1–2 cm.

According to yet another preferred embodiment of the invention, the club head includes a ball-striking face, and the filler material resides in the cavity adjacent to the face.

According to yet another preferred embodiment of the invention, the filler material resides adjacent to an inside top wall of the head.

According to yet another preferred embodiment of the invention, the filler material occupies substantially the entire inside toe area of the head.

According to yet another preferred embodiment of the invention, the filler material occupies greater than 50% of the volume of the cavity.

An embodiment of the method of constructing a golf club with means for dampening the vibration of the club upon impacting a golf ball includes the steps of providing a grip section, an elongated shaft attached to the grip section, and an enlarged head attached to the shaft and defining a cavity therein. A filler material is placed within the cavity, and is adhered to an inside wall of the head. The filler material includes cork particles and an adhesive.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
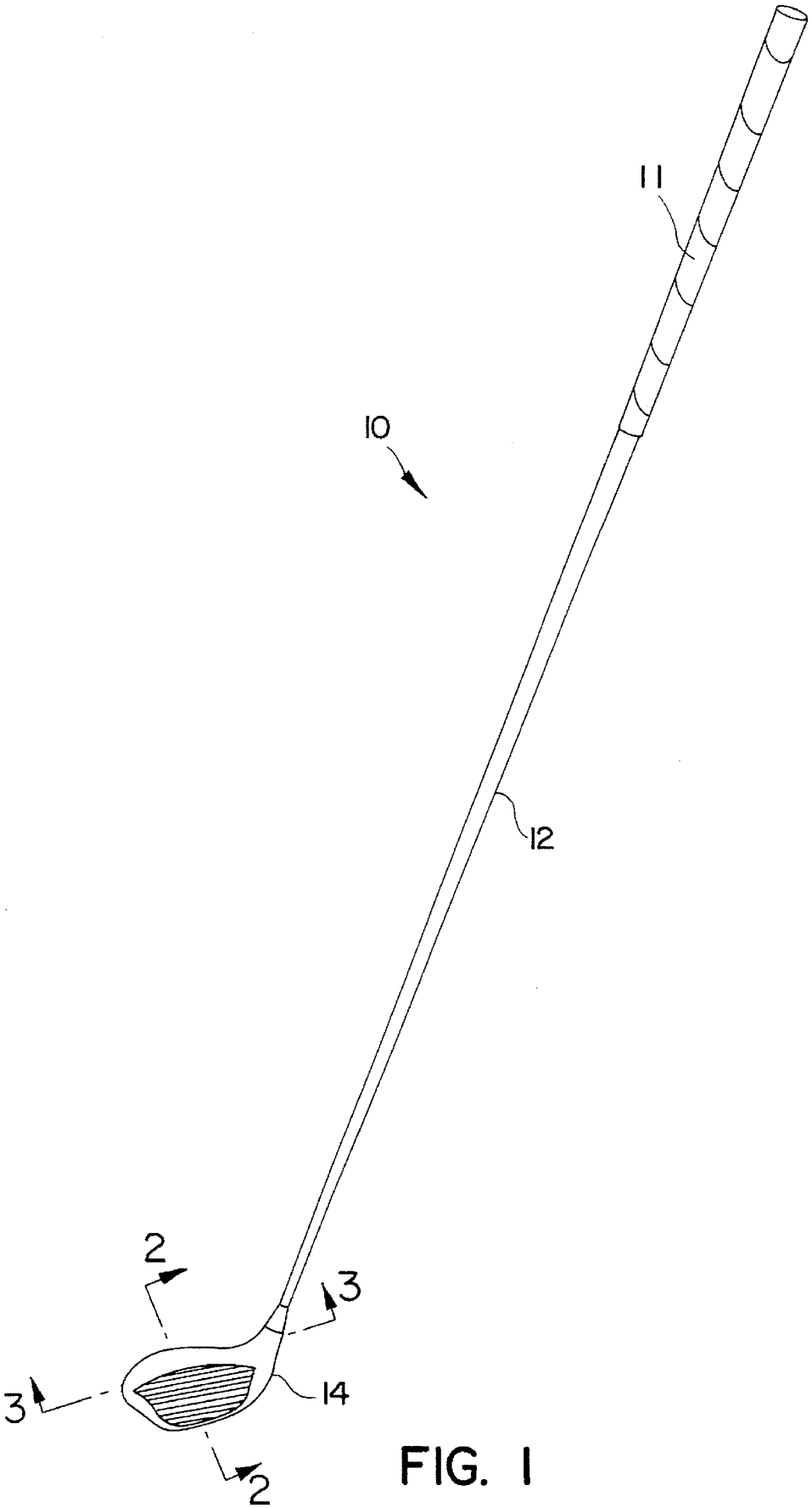
FIG. 1 is a perspective view of the golf club according to one preferred embodiment of the invention.

Referring now specifically to the drawings, a golf club according to the present invention is illustrated in FIG. 1 and shown generally at reference numeral 10. The golf club 10 resembles a conventional golf club, and includes conventional elements such as a grip section 11, elongated shaft 12 attached to the grip section 11, and an enlarged head 14 attached to the shaft 12.

Figure 2:
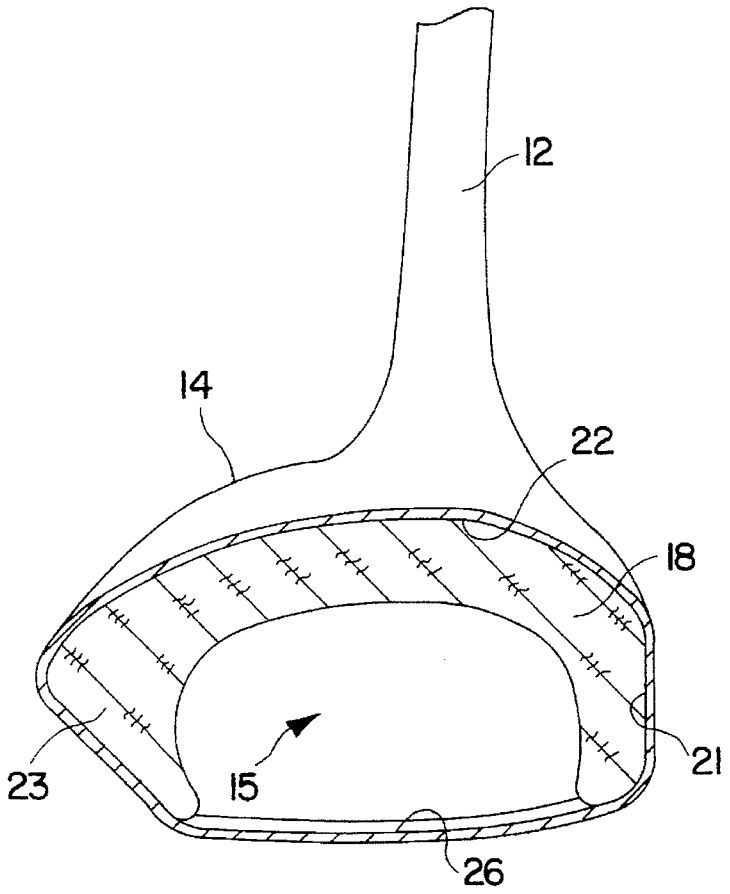
FIG. 2 is a cross-sectional view of the head of the golf club taken substantially along lines 2—2 of FIG. 1.
Figure 3:
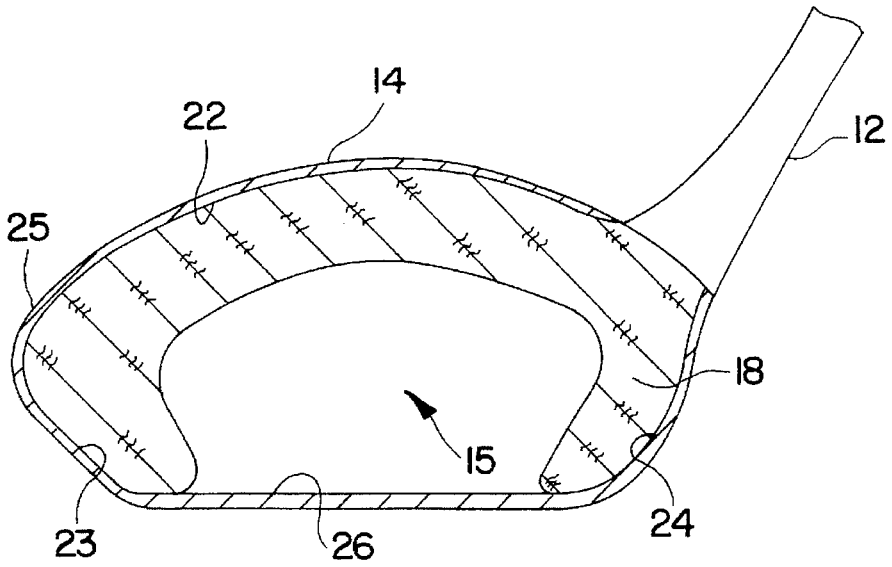
FIG. 3 is a cross-sectional view of the head of the golf club taken substantially along lines 3—3 of FIG. 1.

As shown in FIGS. 2 and 3, the head 14 of the golf club 10 is hollow and defines an interior cavity 15 for receiving a filler material 18. The filler material 18 adheres directly to the inside walls of the head 14, and serves to dampen the vibration of the golf club 10 upon impacting a golf ball. In the embodiment shown, the filler material 18 resides adjacent to a ball-striking face 21, top wall 22, side wall 23 and rear wall 24 of the head 14, and occupies between 50–75% of the total cavity volume. The thickness of the filler material 18 adhering to the face 21 is about 1–2 cm. In addition, the filler material 18 may further occupy substantially the entire toe area 25 of the club head 14.

The filler material 18 preferably includes a mixture of ground cork particles, a urethane oligomer to bond the cork particles together, and an adhesion promoter to adhere the bonded cork particles directly to the inside walls of the club head 14, as previously described. The urethane oligomer is an aliphatic or aromatic oligomer having a polyester or polyether backbone with a molecular weight ranging from between 1000 to 6000 grams/mole. The oligomer may be blended with a variety of different monomers to achieve the desired properties. An example of one urethane oligomer is that sold by Sartomer Chemical Co. of Exton, Pa. under the trade designation "CN 963 Urethane Oligomer". The adhesion promoter is preferably an acidic adhesion promoter, such as a phosphate esther blended with ethoxylated trimethylolpropane triacrylate (EOTMPTA), which is catalyzed to make the compound heat sensitive. One suitable catalyst is a butyronitrile free radical source. Alternatively, other peroxide catalysts may be used as well as gamma or electron beam radiation in order to create free radicals and polymerize the cork/oligomer mixture.

According to one embodiment, the cork particles are initially filtered through a screen or sieve to ensure uniform particle size, and are then blended together with the following wet formulation:

75 parts aliphatic urethane acrylate oligomer blended with 25 parts ethoxylated trimethylolpropane triacrylate (EOTMPTA)-[91.5–97.0% by weight of the total wet formulation];

Acidic adhesion promoter, a phosphate ester blended with ethoxylated trimethylolpropane triacrylate (EOTMPTA)-[0.5–2.0% by weight of the total wet formulation];

Hexanediol diacrylate (HDDA)-[2.0–5.0% by weight of the total wet formulation]; and "VAZO 67" free radical source, catalyst sold by DuPont Chemical; 2,2'-azobis(2-methylbutyronitrile)-[0.5–2.0% by weight of the total wet formulation]

The ratio of cork particles to the above formulation is preferably about 60/40, although other desired proportions may be used.

With the sole plate 26 removed, the filler material 18 is inserted into the club head 14 to completely fill the cavity 15. The club head 14 is then placed in an oven at a temperature of between 200–350 degrees F. for a period of about one hour. As the filler material 18 cures in the oven, it bonds together and adheres to the inside walls of the club head 14. The club head 14 is then cooled at room temperature. A conventional router is used to remove the excess filler material from the center of the cavity 15 to reduce the overall weight of the club head 14. The precise amount and location of filler material 18 remaining in the head 14 is then tailored to achieve the desired weight distribution and maximum vibration absorption for the individual user. Once this is completed, the sole plate 26 is attached to the bottom of the head 14 by welding or other suitable means, and the club 10 is ready for play.

A golf club is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In a golf club comprising a grip section, an elongated shaft attached to the grip section, and an enlarged head attached to the shaft and defining a cavity therein, the improvement comprising a filler material contained in the cavity and adhering to an inside wall of the head for dampening the vibration of the club upon impacting a golf ball, and said filler material occupying at least 50% and less than 100% of the total volume of the cavity and comprising cork particles, a urethane oligomer for bonding the cork particles together, and an adhesion promoter for adhering the cork particles directly to the inside wall of the head.

2. A golf club according to claim 1, wherein said urethane oligomer is an aliphatic urethane oligomer.

3. A golf club according to claim 1, wherein the thickness of the filler material adjacent to the inside wall of the head is between 1–2 cm.

4. A golf club according to claim 1, wherein the club head includes a ball-striking face, and said filler material resides in the cavity adjacent to the face.

5. A golf club according to claim 1, wherein said filler material resides adjacent to an inside top wall of the head.

6. A golf club according to claim 1, wherein said filler material occupies substantially the entire inside toe area of the head.

7. In a metal wood golf club comprising a grip section, an elongated shaft attached to the grip section, and an enlarged head attached to the shalt and defining a cavity therein, the improvement comprising a filler material contained in the cavity and adhering to at least a top inside wall of the head and a ball-striking face for dampening the vibration of the club upon impacting a golf ball, said filler material occupying at least 50% and less than 100% of the total volume of the cavity and comprising cork particles, a urethane oligomer for bonding the cork particles together, and an adhesion promoter for adhering the bonded cork particles directly to the inside wall of the head.

* * * * *